US008839814B2

(12) United States Patent
Phillips et al.

(10) Patent No.: US 8,839,814 B2
(45) Date of Patent: Sep. 23, 2014

(54) WALL MOUNTABLE HOSE REEL

(75) Inventors: William J. Phillips, Batavia, IL (US); Michael R. Vogler, Oswego, IL (US); Torrence Anderson, Overland Park, KS (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 39 days.

(21) Appl. No.: 13/595,014

(22) Filed: Aug. 27, 2012

(65) Prior Publication Data

US 2013/0056094 A1 Mar. 7, 2013

Related U.S. Application Data

(63) Continuation-in-part of application No. 29/400,815, filed on Sep. 1, 2011, now Pat. No. Des. 672,634, and a continuation-in-part of application No. 29/400,819, filed on Sep. 1, 2011, now Pat. No. Des. 672,635, and a continuation-in-part of application No. 29/400,824, filed on Sep. 1, 2011, now Pat. No. Des. 673,030.

(51) Int. Cl.
*B65H 75/38* (2006.01)
*B65H 75/44* (2006.01)

(52) U.S. Cl.
CPC ..... *B65H 75/446* (2013.01); *B65H 75/38* (2013.01); *B65H 2701/533* (2013.01); *B65H 75/441* (2013.01); *B65H 2701/33* (2013.01); *B65H 2701/534* (2013.01)
USPC ..... 137/355.26; 242/397.4; 242/398

(58) Field of Classification Search
USPC ..... 137/355.12, 355.16–355.28; 242/397, 242/397.2, 397.4, 398, 404, 406
See application file for complete search history.

(56) References Cited

U.S. PATENT DOCUMENTS

| | | | | |
|---|---|---|---|---|
| 5,657,789 | A | 8/1997 | Tisbo et al. | |
| 5,934,314 | A * | 8/1999 | Spear et al. | 137/355.16 |
| 5,988,552 | A * | 11/1999 | Tisbo et al. | 242/403.1 |
| 6,050,291 | A * | 4/2000 | Whitehead et al. | 137/355.26 |
| RE37,442 | E * | 11/2001 | Spear et al. | 137/355.27 |
| 6,478,265 | B2 | 11/2002 | Leach | |
| 6,834,670 | B2 | 12/2004 | Rosine et al. | |
| D623,503 | S | 9/2010 | Hatcher et al. | |
| D636,253 | S | 4/2011 | Hatcher et al. | |

* cited by examiner

*Primary Examiner* — Craig Schneider
*Assistant Examiner* — Jonathan Waddy
(74) *Attorney, Agent, or Firm* — McHale & Slavin, P.A.

(57) ABSTRACT

An improved wall mount hose reel of a shape and design allowing preassembly and stacking in a nesting fashion of multiple units. The wall mount hose reel employs a frame for support of a garden hose to be wound into a coil by use of a hose reel spool. A crank handle is provided on the frame and attached to the hose reel spool for winding. An inlet/outlet swivel union fluid conduit is provided in the A-frame. The inlet fluid conduit is adapted for attachment to a water source, located on the outer surface of the A-frame, and adapted for coupling with the outlet conduit. The frame further supports a storage shelf and a rotatable levelwind assembly.

20 Claims, 12 Drawing Sheets

WALL MOUNTABLE HOSE REEL

CROSS REFERENCE TO RELATED APPLICATIONS

This application is a continuation-in-part of U.S. application Ser. No. 29/400,815, entitled, "Wall Mountable Hose Reel" filed on Sep. 1, 2011 now U.S. Pat. No. Des. 672,634, and a continuation-in-part of U.S. application Ser. No. 29/400,819 filed on Sep. 1, 2011 now U.S. Pat. No. Des. 672,635, entitled, "Wall Mountable Hose Reel with Shelf", and a continuation-in-part of U.S. application Ser. No. 29/400,824 filed on Sep. 1, 2011 now U.S. Pat. No. Des. 673,030, entitled, "Wall Mountable Hose Reel with Levelwind", the contents of which are incorporated herein in their entirety.

FIELD OF THE INVENTION

This invention relates to storage of flexible garden hoses, and more particularly to a wall mountable hose reel that includes a spool arranged parallel to the wall surface, and may include a storage shelf and levelwind. The hose reel is pre-assembled and shipped in a stacked array.

BACKGROUND OF THE INVENTION

The use of wall mountable hose reels for convenient handling and storage of a flexible garden hose has risen in popularity. A basic wall mounted hose reel includes a semi-circular shaped hook having a central axis that is positioned perpendicular with respect to the wall surface. The hose is typically coiled over the hook for storage. Use requires the user to take down the hose and uncoil it as needed. While the use of these devices is common, the requirement to manually coil the heavy hose for placement over the hook deters many people from using these devices.

Another type of wall mounted hose reel utilizes a plate mounted to the wall surface. An axle extends outwardly from the plate and perpendicular to the wall. A spool is rotatably mounted for rotation about the axle. A hand grip or knob is provided to rotate the spool. However, this type of wall mounted hose reel typically requires the hose to be pulled off the reel in a direction that is perpendicular to the spool, making the device unsuitable for most users.

It has become common for products such as wall mounted hose reels to be shipped unassembled, as it facilitates more regularly shaped packaging and cost savings for larger pallet loads. For example, a wall mountable hose reel shipped in a disassembled state can easily fit into a box that allows the device to be shipped on a pallet together with numerous other similarly shaped boxes. Thus, it is not unusual to have twenty or more boxes of unassembled wall mountable hose reels placed on a pallet. In addition to requiring tools for assembly, the assembly process can be time consuming and frustrating for the consumer and can lead to damaged goods if the assembly is done improperly. Damage can occur when the consumer fails to either follow instructions, tries to force fit a component, or doesn't have the proper tools for assembly. The result is aggravation to the consumer, who may ask the store to take the product back and refund their money. Accepting the returns not only voids the sale, but increase the cost for the retailer who much complete consuming paperwork to request the manufacturer take the product back. As a result, cottage industries have developed solely for the purpose of assembling products that have been purchased in a disassembled state. Many stores that carry unassembled products have personnel on staff to assemble the product at a cost to the consumer. Thus, a pre-assembled product is preferred by the consumer for cost and aggravation purposes.

By contrast, an assembled product usually becomes bulkier, thus requiring larger packaging and occupying more shipping space. The cost of shipping larger boxes increases the price of the product to the consumer. To combat the requirement of additional space, manufacturers have constructed spools having modified end plates that include flattened or folding sides to facilitate stacking in a more compact arrangement. However, the spools with folding or cut away end plates create issues for users such as additional fragile components that become embrittled in the sun and break. Folding or cut away end plates also create issues when retracting the hose from an angle, causing the hose to wind around the axle adjacent to the spool. Thus, what is lacking in the art is a wall mount hose reel designed to be shipped without bulky packaging in a nested condition to reduce storage and shipping space following pre-assembly at the factory. The wall mountable hose reel should include spool end plates that are full circles when viewed from the end. The wall mountable hose reel should also include options for convenience features such as shelving for accessories and a levelwind to place the hose upon the spool in a controlled and space saving manner. The wall mountable hose reel should be relatively lightweight and should include built in keyhole type apertures to facilitate mounting upon a wall without requiring the person mounting the device to hold it in place during fastener insertion. The wall mountable hose reel should also include built in stop points that provide for shipment in a nested arrangement.

SUMMARY OF THE INVENTION

The present invention provides a wall mountable hose reel. More specifically, the present invention provides a wall mountable hose reel that is provided in an assembled condition and may include convenience features such as shelving and levelwind assemblies. The wall mountable hose reel is shaped to facilitate stacking of multiple units in a nested arrangement for cost efficient shipping. The wall mountable hose reel employs a pre-assembled frame for support of a flexible garden hose to be wound into a coil of multiple layers. The frame is defined by a pair of opposing side frames having cross braces for added strength. A hose spool suitable for containing a supply of flexible garden hose is rotatably disposed between opposing side frames. The spool includes a center portion which is generally cylindrical in shape and includes an endplate secured to each distal end thereof. The end plates are substantially full circles when viewed from the end to provide control over the hose even when being retracted onto the spool from an angle. An inlet swivel union fluid conduit is provided between one of the side frames and the rotatable spool. A first end of the inlet swivel fluid conduit is adapted for attachment to a water source and disposed on the outer surface of the side frame. The inlet conduit is adapted for coupling with an outlet conduit. The outlet conduit is sized to extend through a central portion of the hose reel spool and shaped for attachment to a garden hose without bending or kinking of the hose for attachment. The frame further supports a releasably insertable storage shelf which attaches to the back legs of opposing side frames, allowing for the improved wall mountable hose reel to be built with or without the storage shelf, while still not interfering with the stackable nesting of numerous wall mount hose reels. Lastly, a crank handle is provided on the frame and attached to the hose reel spool for winding of the hose onto the spool. In at least one embodiment, the crank handle includes a folding handle member which provides a more compact shipment arrangement. Such folding handles are disclosed in U.S. Pat. No. 6,834,670, entitled, "Hose Reel Cart with Folding Crank Handle", assigned to the assignee of the present application, the contents of which are incorporated herein.

Accordingly, it is a primary objective of the present invention to provide a wall mountable hose reel having all components preassembled so as to eliminate the need for packaging and instruction manuals commonly used in the prior art.

It is a further objective of the present invention to provide a wall mountable hose reel that can be stacked on top of similar wall mountable hose reels in a nesting fashion, enabling the manufacturer to ship more units per cubic foot volume.

It is yet another objective of the present invention to provide a wall mountable hose reel that includes full side plates on the spool and can be shipped in a nested condition.

It is a still further objective of the present invention to provide a wall mountable hose reel that includes an integrated storage shelf which includes interchangeable support members to allow the improved wall mountable hose reel to be built with or without the storage shelf and not interfere with the nesting arrangement.

Another objective of the present invention is to provide a wall mountable hose reel to accommodate common wall stud spacing for easier installation on a vertical surface.

It is yet another objective of the present invention to provide a wall mountable hose reel that includes keyhole shaped mounting apertures to allow the mounting fasteners to be applied to the wall prior to lifting the hose reel assembly.

It is still yet another objective of the present invention to provide a wall mountable hose reel assembly that includes a levelwind assembly to facilitate compact storage of the elongate hose member.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
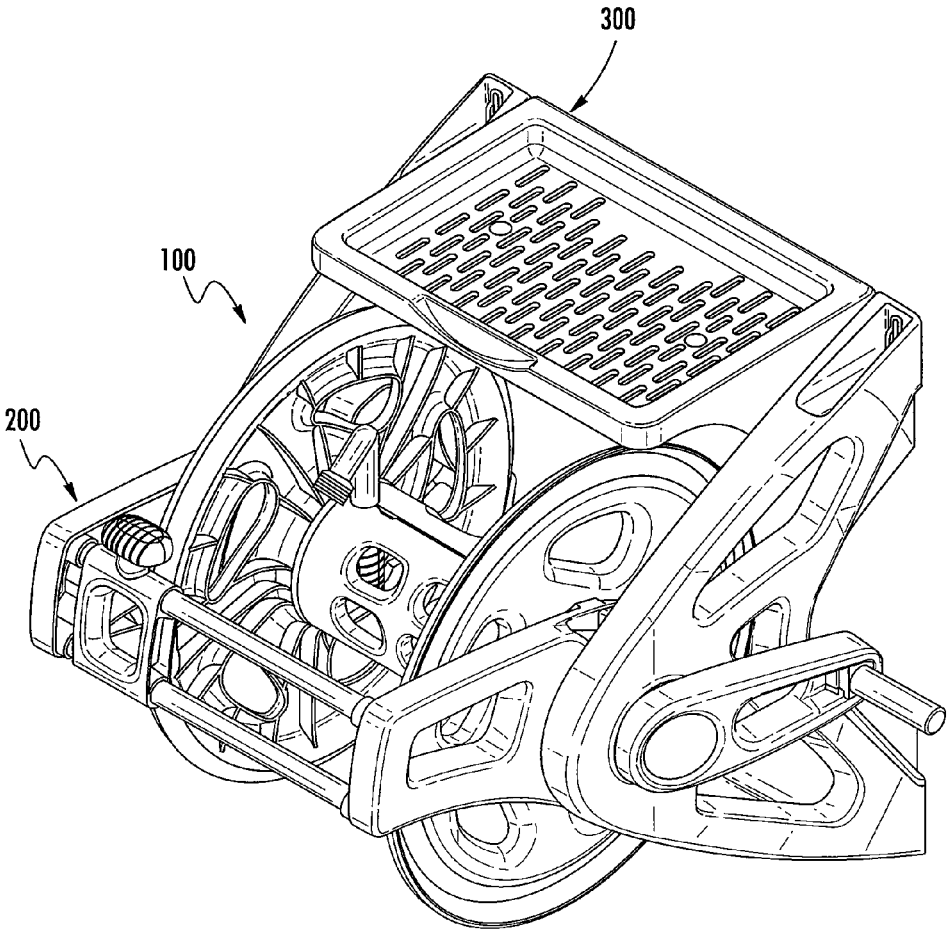
FIG. 1 is a top right perspective view of one embodiment of the present invention, illustrated with a shelf and levelwind assembly.
Figure 2:
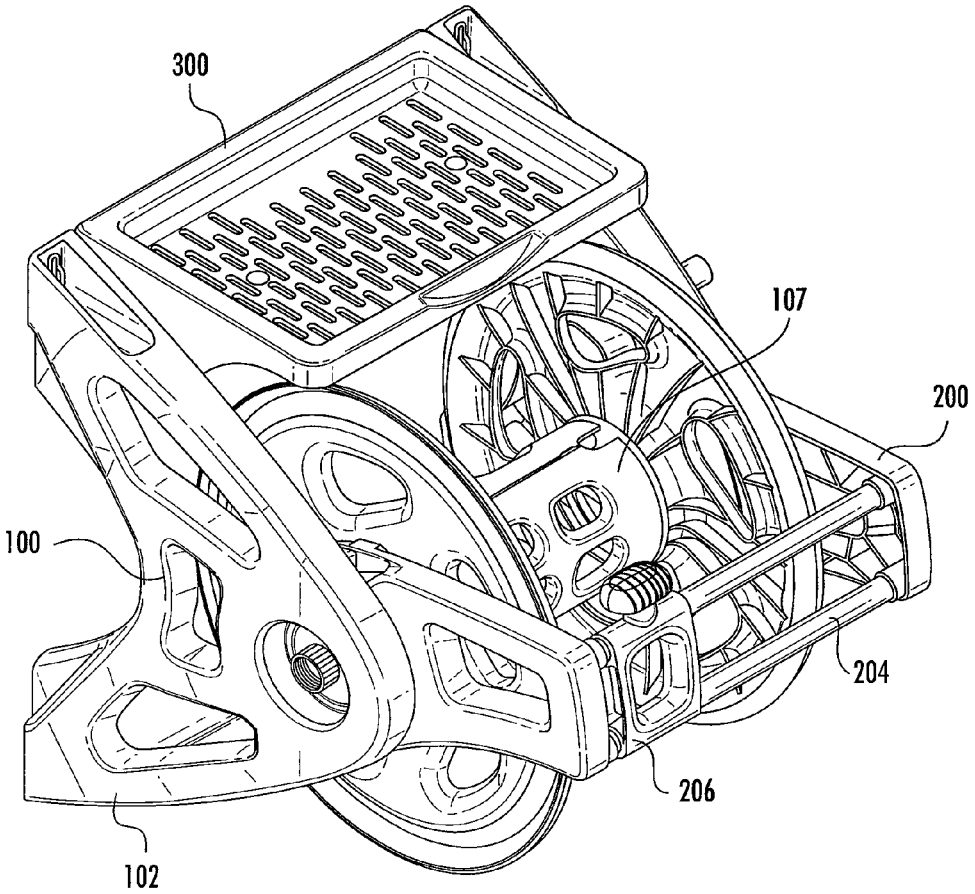
FIG. 2 is a top left perspective view of the embodiment illustrated in FIG. 1.
Figure 3:
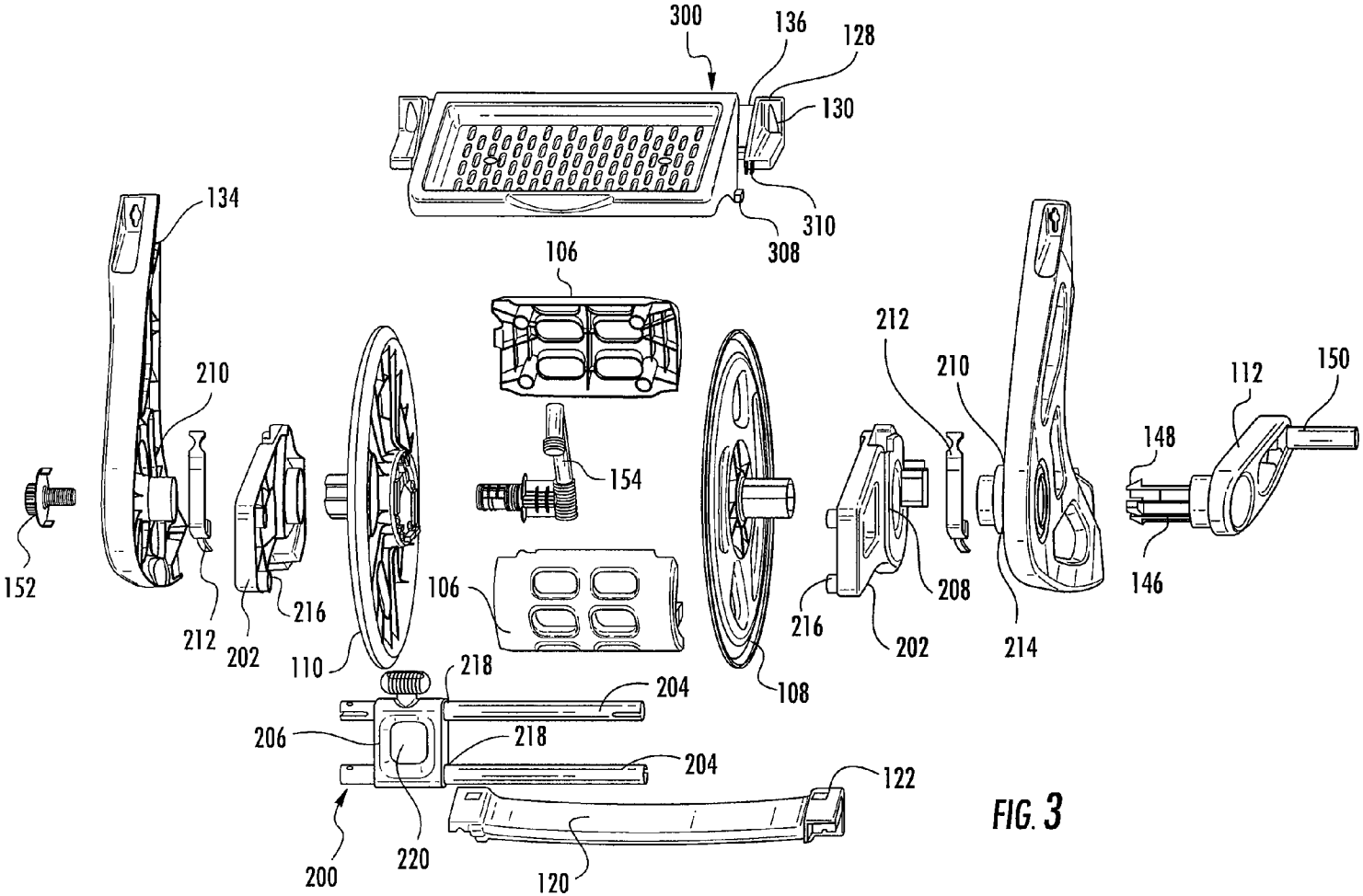
FIG. 3 is an exploded view of the embodiment illustrated in FIG. 1.
Figure 4:
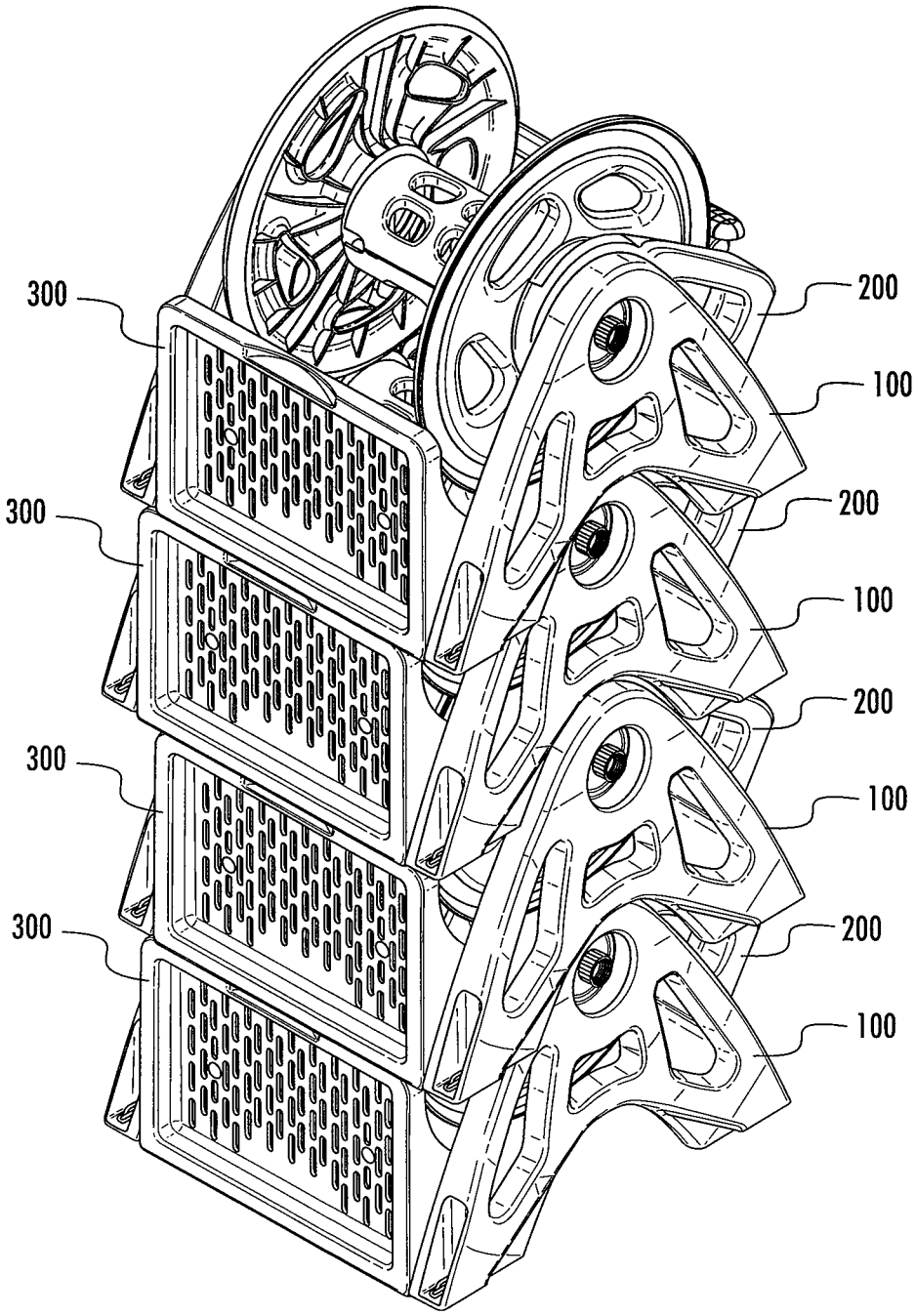
FIG. 4 is a perspective view of the embodiment illustrated in FIG. 1, showing the nested shipping arrangement.
Figure 5:
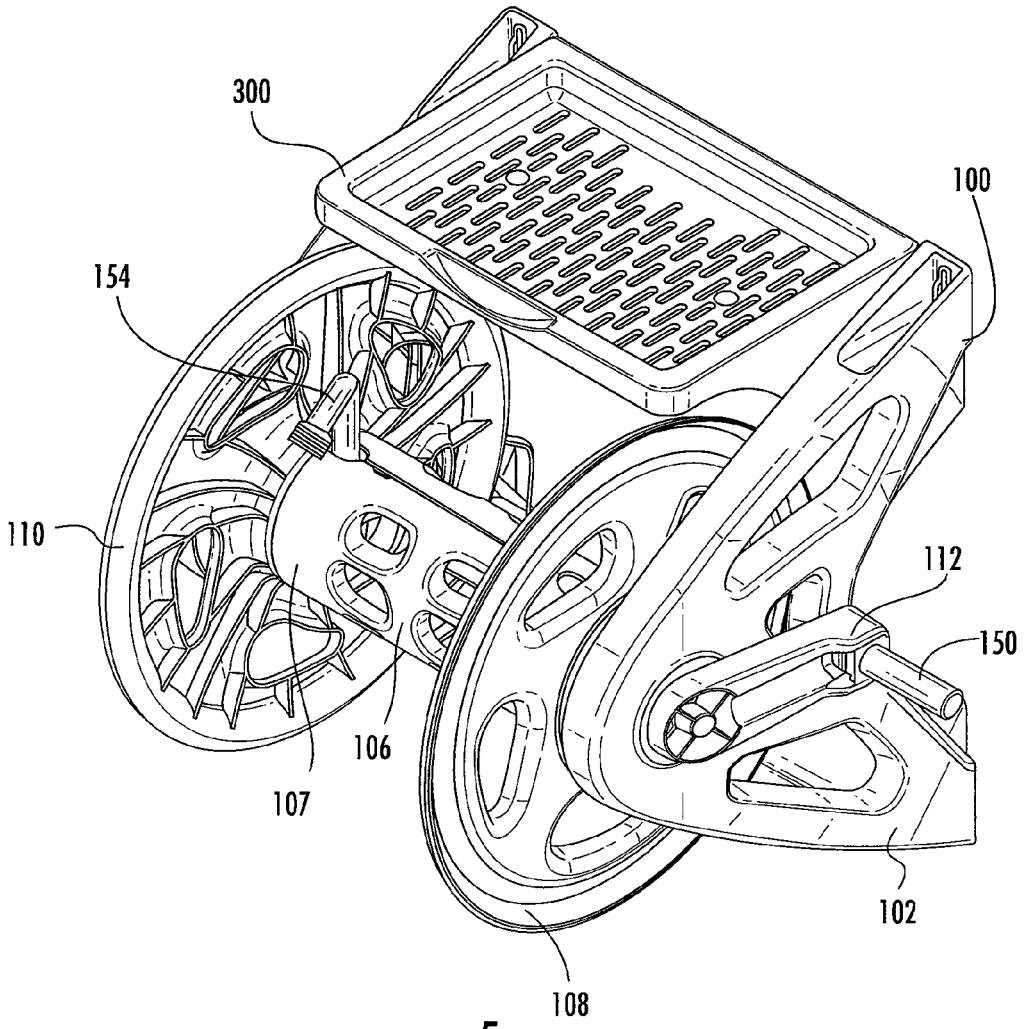
FIG. 5 is a top right perspective view of one embodiment of the present invention, illustrated with a shelf.
Figure 6:
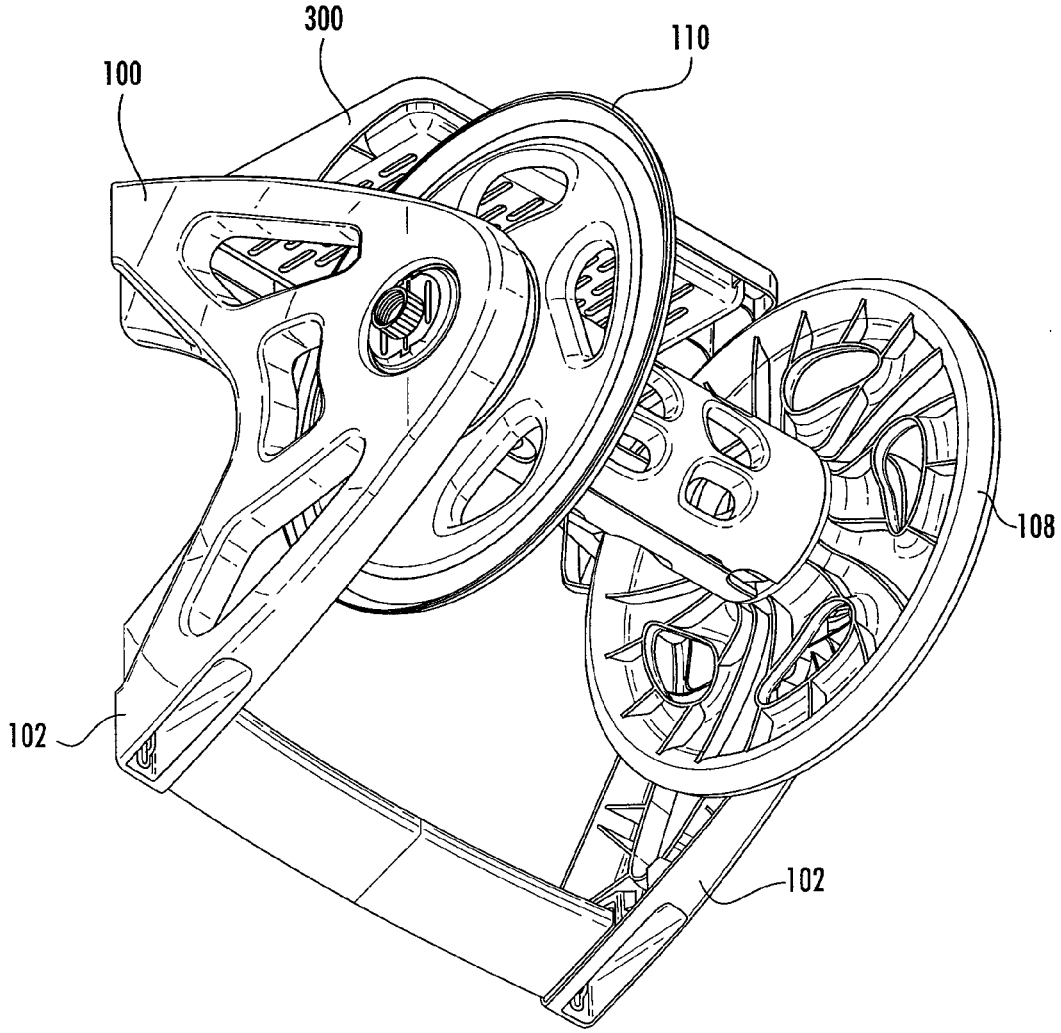
FIG. 6 is a bottom left perspective view of the embodiment illustrated in FIG. 5.
Figure 7:
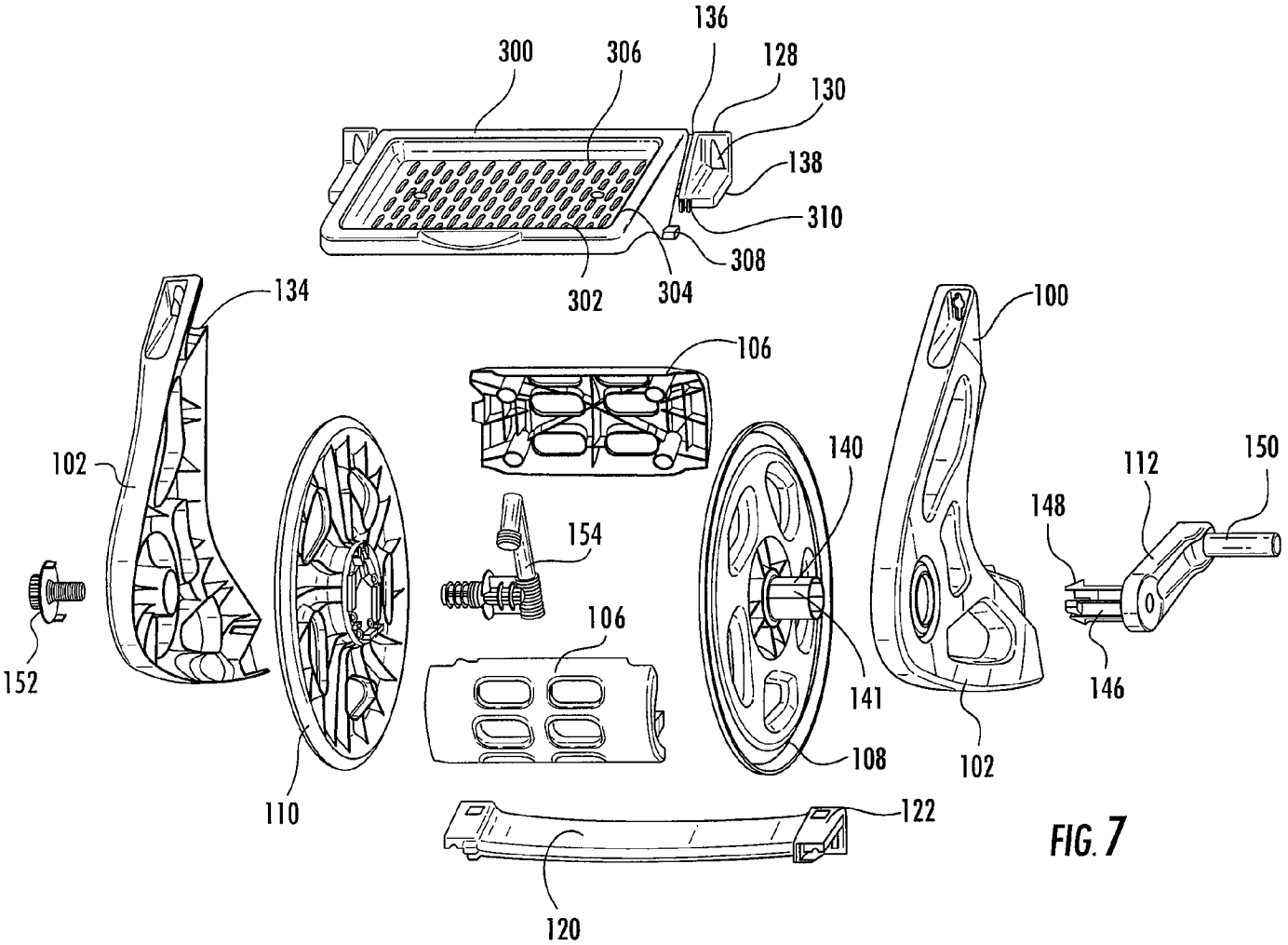
FIG. 7 is an exploded view of the embodiment illustrated in FIG. 6.
Figure 8:
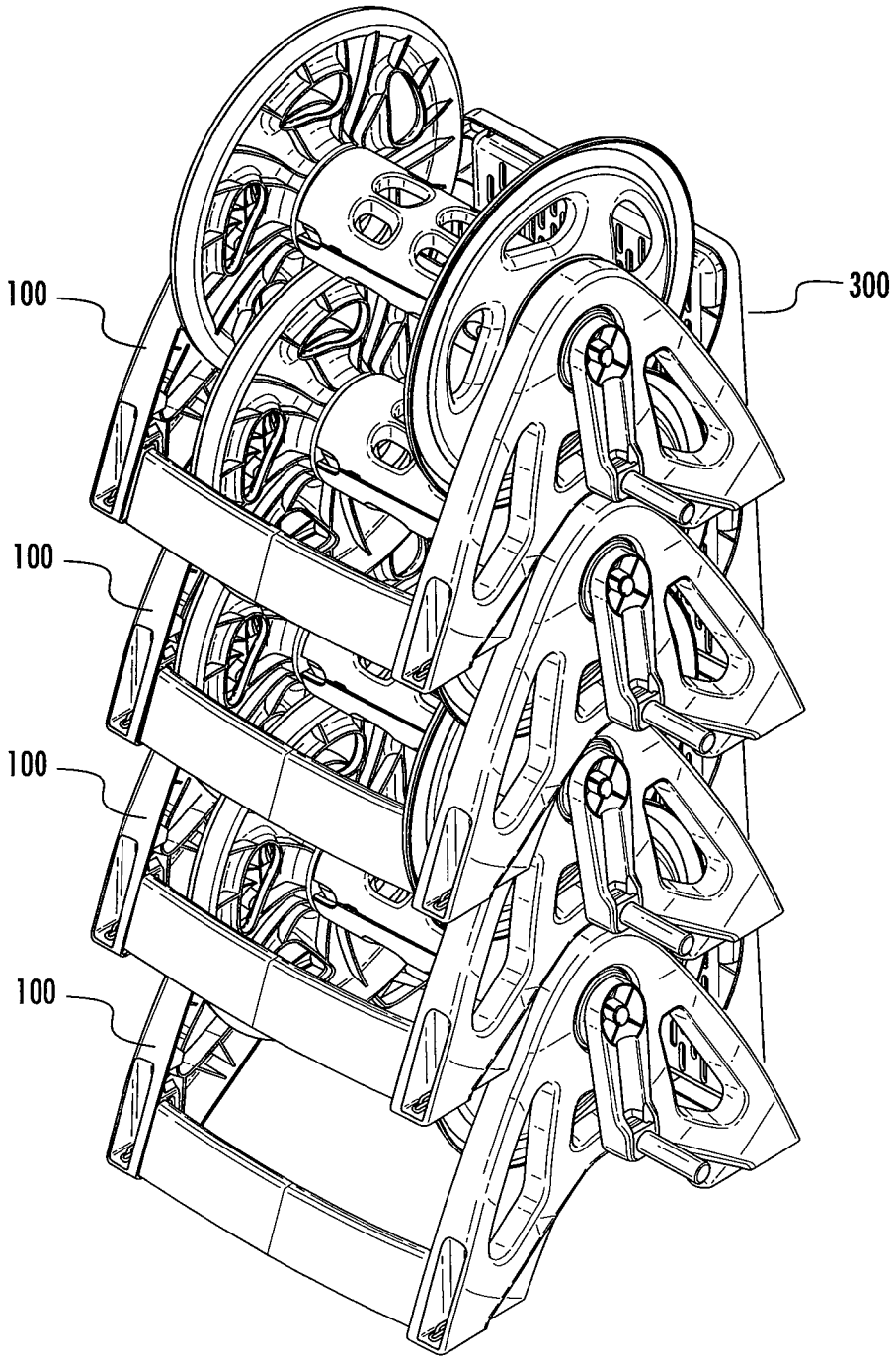
FIG. 8 is a perspective view of the embodiment illustrated in FIG. 5, showing the nested shipping arrangement.
Figure 9:
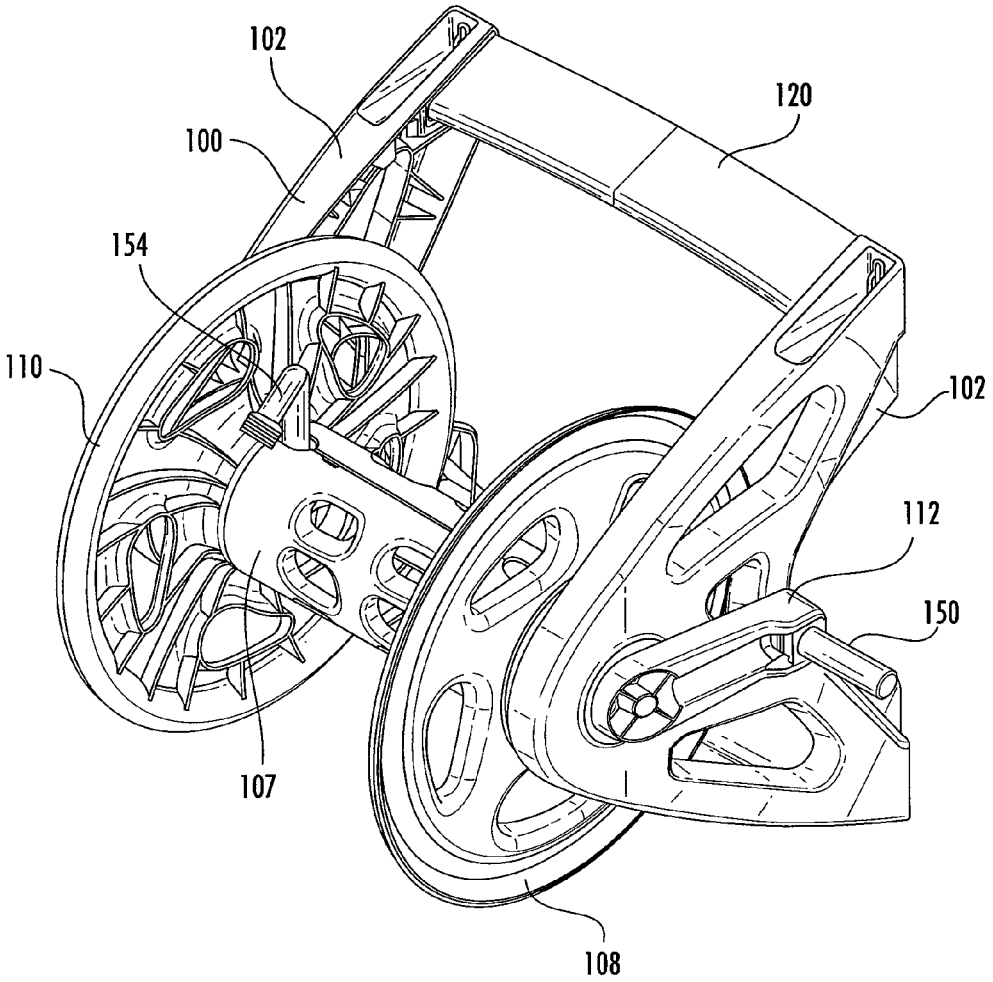
FIG. 9 is a top right perspective view of one embodiment of the present invention.
Figure 10:
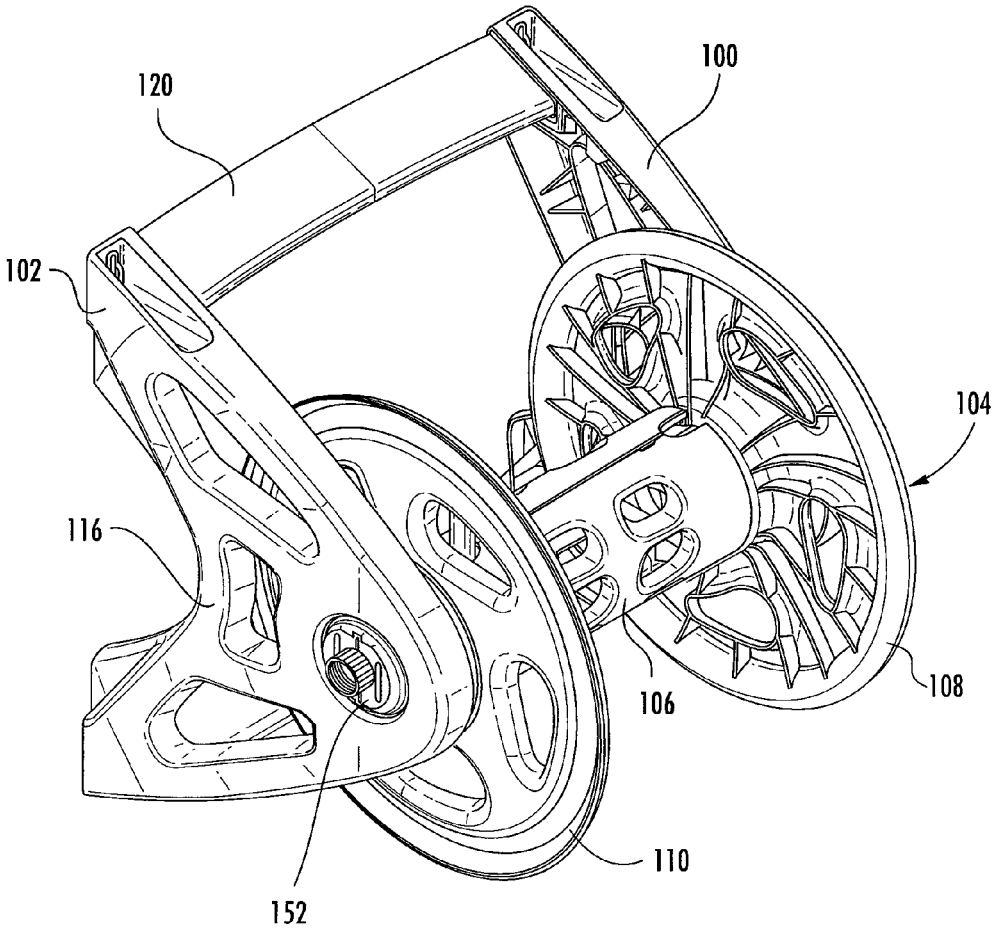
FIG. 10 is a top left perspective view of the embodiment illustrated in FIG. 9.
Figure 11:
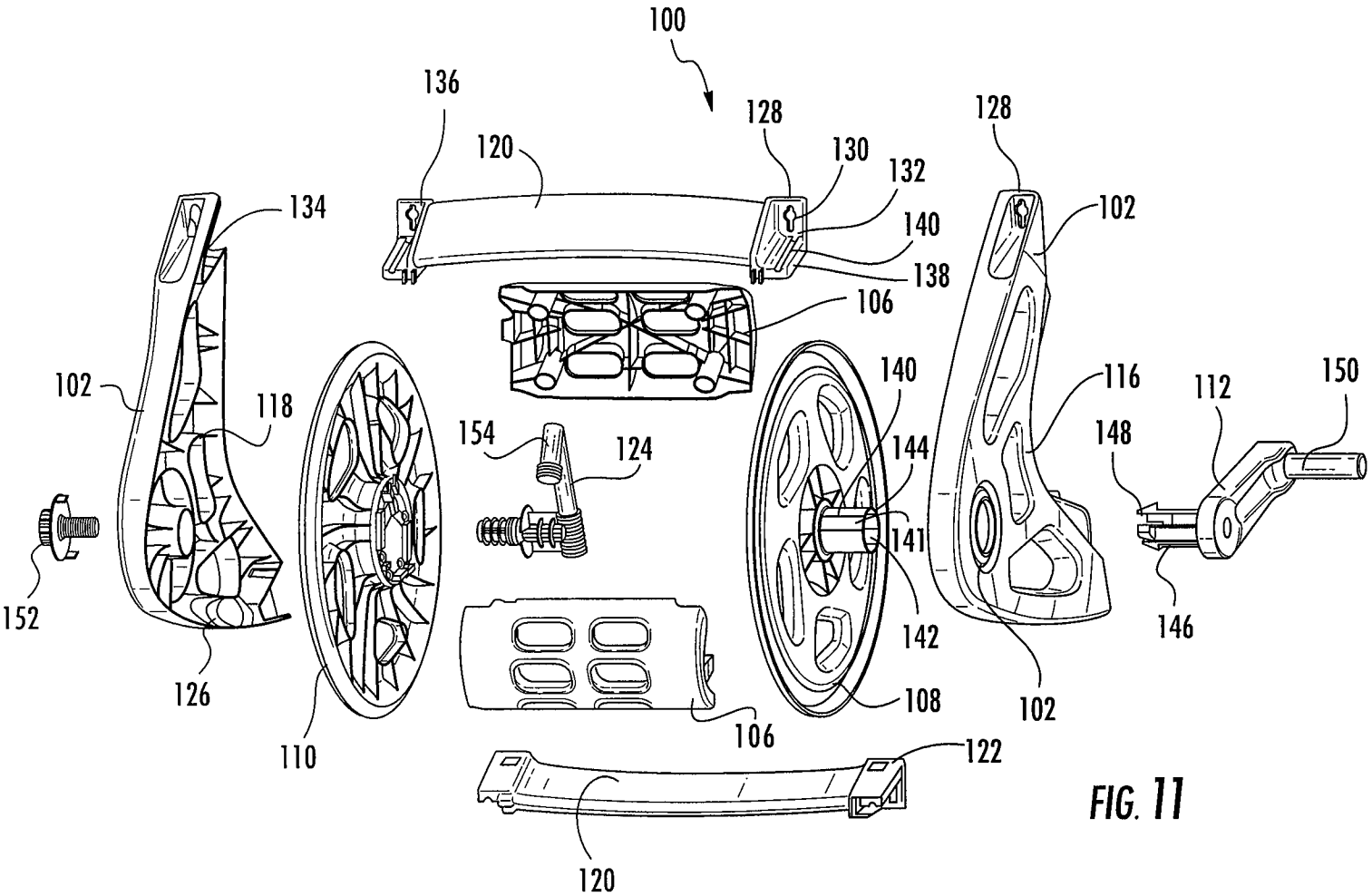
FIG. 11 is an exploded view of the embodiment illustrated in FIG. 9.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 12:
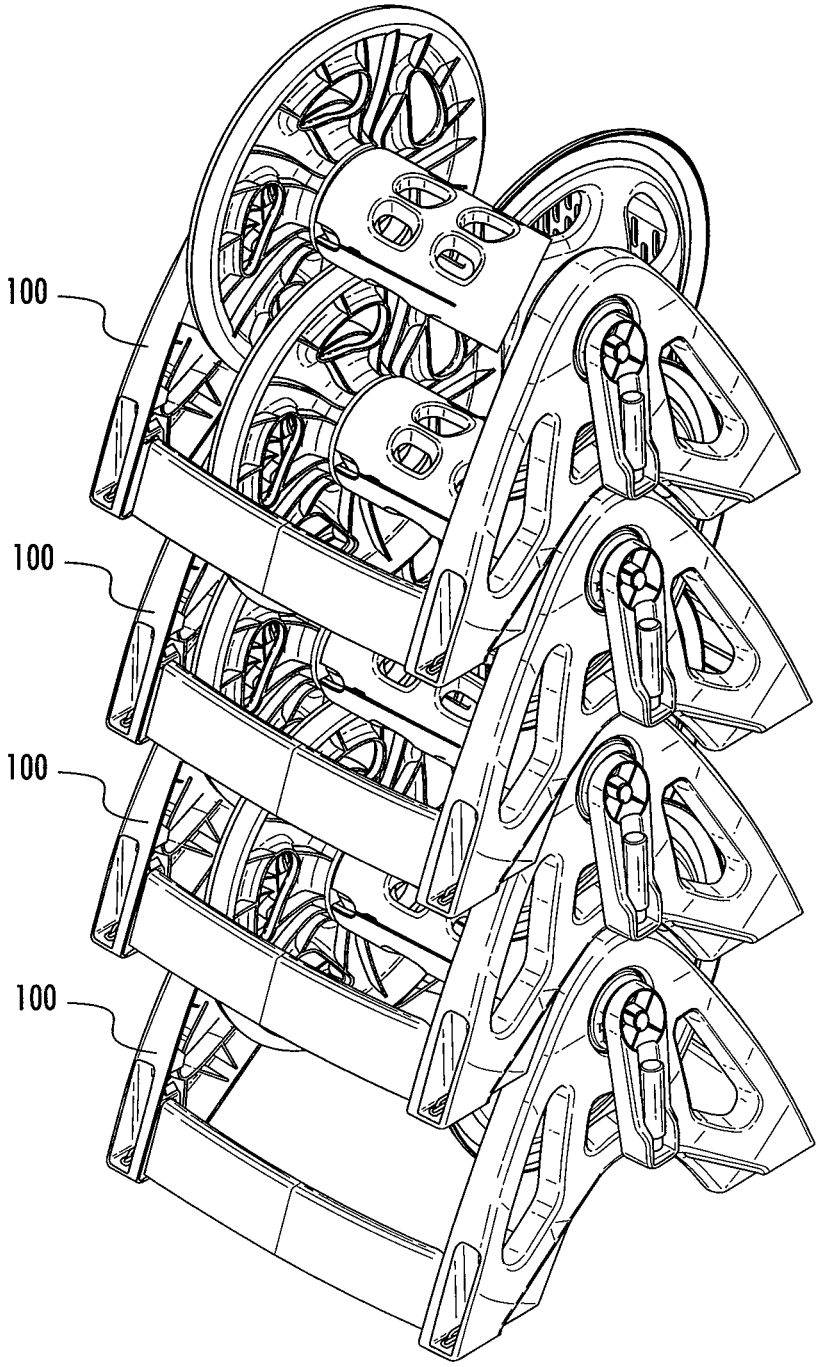
FIG. 12 is a perspective view of the embodiment illustrated in FIG. 9, showing the nested shipping arrangement.

Now referring to FIGS. 1-12, various embodiments of the present invention are illustrated. FIGS. 1-4 illustrate a wall mountable hose reel 100 which is provided with a levelwind assembly 200 and a shelf assembly 300. FIGS. 5-8 illustrated an embodiment of the wall mountable hose reel assembly that includes a shelf assembly 300. FIGS. 9-12 illustrate the basic wall mountable hose reel assembly. The wall mountable hose reel assembly 100 generally includes opposing side frames 102, a spool assembly 104, an inlet/outlet fluid swivel 124, a crank assembly 112, and a pair of crossbars. The opposing side frames 102 are structural members having suitable strength to support the spool assembly when loaded with hose that may be full of water. The side frames are preferably tapered from the bottom to the top so that the top portion of one side frame fits into the bottom portion of a vertically stacked side frame as illustrated in FIG. 12. The side frames 102 each include a vertical stop member 116 that functions as a strengthening member for the side frame as well as a stop member for the nested arrangement. In at least one embodiment, the bottom portion of the side frames include a pair of split legs and the stop member, a semi-circular geometric shape which allows the nesting of similarly shaped frames on top of each other as the top surface of each frame has a similar semi-circular geometric shape for mating of the top surface of one frame with the bottom surface of another frame. In this manner, the stacked arrangement has a predetermined stop member to prevent one wall mountable hose reel from being forced over another hose reel during transport to prevent shipping damage. The side frames 102 are also constructed to prevent lateral movement of the nested arrangement by allowing a portion of the spool driven end plate 110 to cooperate with a vertically placed wall mountable hose reel assembly. In a most preferred embodiment, the outer surface of the lower nested hose reel cooperates with an inner surface of the next vertically stacked hose reel assembly. Each side frame 102 includes a bearing journal 126 sized to cooperate with the driving and driven end plates 108, 110 of the spool assembly 104. Each side frame 102 also includes a keyhole aperture 128 having an enlarged center portion 130 sized to fit over the head portion of a fastener. The keyhole aperture 128 includes a pair of oppositely extending slots 132 sized to cooperate with the shank portion of a fastener. In this manner, the fasteners may be pre-placed within a wall surface and the center portion of the keyhole aperture placed over the fasteners and slid downwardly to support the wall mountable hose reel on a vertical surface. The slots 132 extending outward from the center portion 130 of the keyhole aperture 128 allow the crank assembly to be mounted on the left or the right side of the assembly. Crossbars 120 extend between the side frames 102 at a lower portion thereof. The distal ends 122 of the crossbars 120 include shaped bosses 136 having a conjugate shape to fit into contoured pockets 134. In a most preferred embodiment the bosses include a key member 138, the key member having a keyway 140 sized to cooperate with a key (not shown) integrally formed into the contoured pocket 134. In this manner, the crossbars 120 may be snapped into an interlocking position with respect to both side panels without the need for additional fasteners. In a most preferred embodiment, each shaped boss 136 includes the like shaped keyhole aperture 128 to that of the side frame 102. The keyhole apertures of the crossbar are positioned to align with the keyhole apertures 128 of the side frames. This construction provides additional rigidity to the assembly, especially when secured to a wall surface. This rigidity is extremely important to counteract the cantilever effect of the weight of a water filled hose positioned on the spool assembly 104. In a preferred, but non-limiting embodiment, the side frame 102 is constructed from a moldable plastic material, such as polyethylene formed by the process of injection molding. In this manner, the side frame 102 can be formed as a substantially hollow structure having a plurality of strengthening ribs 118 formed integrally thereto. In a most preferred embodiment, the side frames are formed for use on either side of the spool assembly to minimize the part count required to assemble the wall mountable hose reel.

As shown in FIGS. 1-12, the spool assembly 104 is positioned between the hub bearing journals 126 of each side frame 102. The spool assembly 104 is comprised of two identically molded semi-circular core halves 106, a drive end plate 108 and a driven end plate 110. The core halves are generally constructed and arranged to connect without the need for additional fasteners to form a hose spool core 107 for receipt of a flexible hose. The driving end plate 108 includes bearing 140 sized to cooperate with bearing journal 126 to allow rotation of the spool assembly 104. The outer surface of the bearing includes notches 141 which serve to scrape away dirt and debris that may enter between the bearing and the bearing journal. The bearing 140 includes a central shaped aperture 142 which preferably includes a plurality of key surfaces 144. The key surfaces cooperate in an interlocking manner with keys 146 integrally formed onto the crank assembly 112. The keys extend to flexible fingers 148 constructed and arranged to flex inwardly as the crank assembly is inserted through the side frame and into the shaped aperture 142, whereby the fingers spring outwardly to catch against an inner surface (not shown). The crank assembly 112 includes a foldable handle 150 to provide a compact storage arrangement. The inlet/outlet assembly 124 is constructed and arranged to extend through the shaped aperture of the driven end plate 110 for attachment of a garden hose to the inlet portion 152; while the outlet portion 154 extends outward through the spool core for attachment to the garden hose to be stored.

Referring to FIGS. 5-8, an embodiment of the wall mountable hose reel with shelf is illustrated. This embodiment is the same as the embodiment disclosed above with the addition of a shelf member 300. The shelf member is substituted for one of the crossbars 120. In a preferred embodiment, the shelf member includes a shelf portion 302 having a perimeter lip 304. The shelf portion may include perforations 306 constructed and arranged to allow water drainage. The edges of the shelf member include the shaped bosses 136 having a conjugate shape to fit into the contoured pockets 134. In a most preferred embodiment the bosses include a key member 138 which cooperates with a surface of the contoured pocket 134. Snap locks 310 are provided to cooperate with the side frames 102 for attachment of the shelf or crossbar to the side frame without additional fasteners. In this manner, the crossbars 120 may be snapped into an interlocking position with respect to both side panels without the need for additional fasteners. In a most preferred embodiment, each crossbar boss portion 136 includes the like shaped keyhole aperture 128 to that of the side frame 102. The keyhole apertures of the crossbar are positioned to align with the keyhole apertures 128 of the side frames. This construction provides additional rigidity to the assembly, especially when secured to a wall surface. This rigidity is extremely important to counteract the cantilever effect of the weight of a water filled hose positioned on the spool assembly 104. In addition, this construction allows the shelf to be directly coupled to the wall surface, instead of an indirect connection through the frame of the hose reel, as is seen in the prior art. In addition to the shaped bosses 136, the shelf is provided with a pair of outwardly extending pin members 308 which cooperate with the side frame 102 to add additional stability to the shelf member.

Referring to FIGS. 1-4, an alternative embodiment of the wall mountable hose reel is illustrated including a levelwind assembly 200 positioned between the spool assembly 104 and the side frame members 102. The levelwind assembly includes rotational arms 202, parallel tracks 204 and a shuttle member 206. The rotational arm members include a bearing aperture 208 which cooperates with a second bearing journal 210 formed on the inner surface of the side frame members 102 to allow rotation of the levelwind between a storage position, illustrated in FIG. 4, and a use position, illustrated in FIGS. 1-3. A spring lock member 212 cooperates with catches 214 to permit a user to rotate the levelwind between the storage and use positions without compromising the ability to nest the devices. The rotational arms include pockets 216 sized to cooperate with the distal ends of the parallel tracks 204. Shuttle member 206 includes a pair of elongated apertures 218 sized for manual traversal along the parallel tracks 204. The shuttle member is also provided with a central aperture 220 sized for traversal of an elongated hose member. In use, as the crank assembly 112 is rotated, the user can traverse the shuttle member back and forth across the spool assembly to provide a compact hose storage arrangement.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A wall mountable hose reel comprising:

a pair of opposing side frame members in a spaced apart arrangement for supporting a rotationally mounted spool assembly, said side frames generally having an A-shape when viewed from the side including a pair of split legs and a strengthening cross member, each of said split legs including a keyhole shaped aperture for securing said side frames to a wall surface, each of said split legs including a contoured pocket positioned on a lower portion thereof for interlocking engagement with a cross brace, each said cross brace extending between said pair of side frame members, an upper portion of each said side frame including a bearing journal for rotationally supporting said spool assembly;

each said cross brace including a center portion and a pair of distal ends, each said distal end including a shaped boss, said shaped boss having a substantially conjugate shape to fit into said contoured pocket for said interlocking engagement therebetween, each said shaped boss including a keyhole aperture positioned to align with said keyhole aperture in said side frame;

said spool assembly positioned between said bearing journals of each side frame, said spool assembly comprised of two semi-circular core halves forming a core, a drive end plate secured to one end of said core and a driven end plate secured to an opposite end of said core, each of said end plates including a bearing sized to cooperate with said bearing journals to allow rotation of said spool assembly;

an inlet/outlet fluid swivel constructed and arranged to extend through a shaped aperture of the driven end plate for attachment of a garden hose to an inlet portion while an outlet portion extends outward through the spool core for attachment to the garden hose to be stored, said inlet portion being rotationally and sealably secured to said outlet portion; and a crank assembly operatively secured to said drive end plate for manual rotation thereof.

2. The wall mountable hose reel of claim 1 wherein said shaped boss includes a key member, said key member having a keyway sized to cooperate with a key integrally formed into said contoured pocket.

3. The wall mountable hose reel of claim 1 wherein said cross member is a vertical stop member, whereby the top portion of a side frame of a first wall mounted hose reel fits into the bottom portion of a second vertically nested wall mountable hose reel assembly and the top portion of said side frame of a first wall mounted hose reel contacts said stop member.

4. The wall mountable hose reel of claim 3 wherein a bottom surface of said stop member includes a semi-circular geometric shape, and a top surface of each said side frame includes a substantially conjugately shaped semi-circular geometric shape for mating of the top surface of one said side frame member with the bottom surface of a second vertically nested said cross member.

5. The wall mountable hose reel of claim 1 wherein said keyhole aperture includes an enlarged center portion sized to fit over the head portion of a fastener and a pair of oppositely extending slots sized to cooperate with the shank portion of a fastener, whereby said wall mountable hose reel may be mounted with said crank assembly on a left or a right side of said spool assembly.

6. The wall mountable hose reel of claim 1 wherein each said side frame bearing journal is sized to cooperate with a respective spool bearing flange, each said spool bearing flange extending outwardly from said drive and said driven end plates of said spool assembly.

7. The wall mountable hose reel of claim 6 wherein an outer surface of said spool bearing flange includes notches which serve to scrape away dirt and debris that may enter between said bearing flange and said bearing journal.

8. The wall mountable hose reel of claim 6 wherein said spool bearing flange of said drive end plate includes a centrally positioned shaped aperture, said shaped aperture of said spool bearing flange of said drive end plate including at least one key surface, said at least one key surface constructed and arranged to cooperate in an interlocking manner with at least one key integrally formed onto said crank assembly.

9. The wall mountable hose reel of claim 6 wherein said spool bearing flange of said drive end plate includes a centrally positioned shaped aperture, said shaped aperture of said spool bearing flange of said drive end plate including a plurality of key surfaces, said plurality of key surfaces constructed and arranged to cooperate in an interlocking manner with a plurality of keys integrally formed onto said crank assembly.

10. The wall mountable hose reel of claim 8 wherein said at least one key extends to include a flexible finger, said flexible finger constructed and arranged to flex inwardly as said crank assembly is inserted through said side frame and into said shaped aperture of said spool bearing flange of said drive end plate, whereby said at least one finger springs outwardly to catch against an inner surface of said spool bearing flange to lock said crank assembly in place.

11. The wall mountable hose reel of claim 9 wherein said plurality of keys each extends to include a flexible finger, each said flexible finger constructed and arranged to flex inwardly as said crank assembly is inserted through said side frame and into said shaped aperture of said spool bearing flange of said drive end plate, whereby said fingers spring outwardly to catch against a plurality of inner surfaces of said spool bearing flange to lock said crank assembly in place.

12. The wall mountable hose reel of claim 1 wherein said wall mountable hose reel includes a shelf member.

13. The wall mountable hose reel of claim 12 wherein said shelf member is substituted for one of said cross braces, said shelf member including a shelf portion having a perimeter lip, the outer edges of said shelf member including integrally formed shaped bosses, said shaped bosses of said shelf member having a substantially conjugate shape to said contoured pockets for interlocking engagement therewith.

14. The wall mountable hose reel of claim 13 wherein said shaped bosses of said shelf member include a key member, said key member constructed and arranged to cooperate with a surface of said contoured pocket to provide additional engagement therebetween.

15. The wall mountable hose reel of claim 13 wherein said shaped bosses of said shelf member are each provided with at least one snap lock, said at least one snap lock constructed and arranged to flex during insertion of said shelf member and spring back to engage a surface upon installation of said shelf member for attachment of said shelf to said side frame without additional fasteners.

16. The wall mountable hose reel of claim 13 wherein each said shaped boss of said shelf member includes a keyhole aperture sized and shaped to align with said keyhole aperture of said side frame, whereby said shelf is directly secured to a set of wall fasteners.

17. The wall mountable hose reel of claim 1 wherein said wall mountable hose reel includes a levelwind assembly positioned between said spool assembly and said side frame members.

18. The wall mountable hose reel of claim 17 wherein said levelwind assembly includes a pair of arms, a pair of parallel tracks and a shuttle member.

19. The wall mountable hose reel of claim 18 wherein said pair of arms include a bearing aperture, said bearing aperture constructed and arranged to cooperate with a second bearing journal formed on an inner surface of said side frame members to allow rotation of said levelwind assembly between a storage position and a use position.

20. A wall mountable hose reel comprising:

a pair of opposing side frame members in a spaced apart arrangement for supporting a rotationally mounted spool assembly, said side frames generally having an A-shape when viewed from the side including a pair of split legs and a strengthening cross member, each of said split legs including a keyhole shaped aperture for securing said side frames to a wall surface, each of said split legs including a contoured pocket positioned on a lower portion thereof for interlocking engagement with a cross brace, each said cross brace extending between said pair of side frame members, an upper portion of each said side frame including a bearing journal for rotationally supporting said spool assembly;

said cross brace including a center portion and a pair of distal ends, each said distal end including a shaped boss, said shaped boss having a substantially conjugate shape to fit into said contoured pocket for an interlocking engagement therebetween;

a shelf member comprising one of said cross braces, said shelf member including a shelf portion having a perimeter lip, the outer edges of said shelf member including integrally formed shaped bosses, said shaped bosses of said shelf member having a substantially conjugate shape to said contoured pockets for interlocking engagement therewith, each said shaped bosses of said shelf member including a keyhole aperture sized and shaped to align with said keyhole aperture of said side frame, whereby said shelf is directly securable to a set of wall fasteners;

said spool assembly positioned between said bearing journals of each side frame, said spool assembly comprised of two semi-circular core halves forming a core, a drive end plate secured to one end of said core and a driven end plate secured to an opposite end of said core, each of said end plates including a bearing sized to cooperate with said bearing journals to allow rotation of said spool assembly;

an inlet/outlet fluid swivel constructed and arranged to extend through a shaped aperture of the driven end plate for attachment of a garden hose to an inlet portion while an outlet portion extends outward through the spool core for attachment to the garden hose to be stored, said inlet portion being rotationally and sealably secured to said outlet portion; and a crank assembly operatively secured to said drive end plate for manual rotation thereof.

* * * * *